US008292529B2

(12) United States Patent
Francavilla

(10) Patent No.: US 8,292,529 B2
(45) Date of Patent: Oct. 23, 2012

(54) DISPENSER AND METHOD FOR DISPENSING FLUIDS

(75) Inventor: Frank Francavilla, Wantage, NJ (US)

(73) Assignee: Lucas Packaging Group, Inc, Branchville, NJ (US)

( * ) Notice: Subject to any disclaimer, the term of this patent is extended or adjusted under 35 U.S.C. 154(b) by 1154 days.

(21) Appl. No.: 12/146,762

(22) Filed: Jun. 26, 2008

(65) Prior Publication Data

US 2009/0003921 A1 Jan. 1, 2009

Related U.S. Application Data

(60) Provisional application No. 60/947,130, filed on Jun. 29, 2007.

(51) Int. Cl.
*B43K 24/02* (2006.01)

(52) U.S. Cl. ..... 401/101; 401/99; 401/117; 401/175; 401/277

(58) Field of Classification Search ..... 401/99–116, 401/117, 175, 101, 59–61, 91, 95–96, 98, 401/121, 243–247, 262, 269
See application file for complete search history.

(56) References Cited

U.S. PATENT DOCUMENTS

| | | | | |
|---|---|---|---|---|
| 2,247,357 | A * | 7/1941 | Brus | 222/498 |
| 2,611,915 | A * | 9/1952 | Prokop et al. | 401/116 |
| 4,403,624 | A | 9/1983 | Montgomery | |
| 4,687,364 | A | 8/1987 | Kingsford | |
| 4,750,502 | A | 6/1988 | Ser et al. | |
| 4,836,704 | A | 6/1989 | Roeder | |
| 4,838,722 | A * | 6/1989 | Katz | 401/101 |
| 4,976,562 | A | 12/1990 | Spivey et al. | |
| 4,991,749 | A | 2/1991 | Kay et al. | |
| 5,000,755 | A | 3/1991 | Anderson | |
| 5,042,955 | A | 8/1991 | Moscatelli | |
| 5,247,951 | A | 9/1993 | Machida et al. | |
| 5,349,972 | A | 9/1994 | Dirksing et al. | |
| 5,490,737 | A | 2/1996 | Gueret | |
| 5,851,079 | A | 12/1998 | Horstman et al. | |
| 5,951,185 | A | 9/1999 | Kingsford et al. | |
| 6,231,256 | B1 | 5/2001 | Kingsford et al. | |
| 6,371,129 | B1 * | 4/2002 | Le Bras-Brown et al. | 401/108 |
| 6,718,990 | B1 | 4/2004 | Neu et al. | |
| 7,114,505 | B2 | 10/2006 | Bauer et al. | |
| 7,237,973 | B1 | 7/2007 | Lou | |
| 2004/0184865 | A1 * | 9/2004 | Carroll | 401/107 |
| 2005/0036823 | A1 | 2/2005 | Butcher et al. | |
| 2006/0067781 | A1 | 3/2006 | Pleil et al. | |
| 2008/0056807 | A1 | 3/2008 | Vintimiglia | |

FOREIGN PATENT DOCUMENTS

| | | |
|---|---|---|
| DE | 3808853 | 10/1989 |
| EP | 0163323 | 9/1988 |
| EP | 0237487 | 9/1990 |
| EP | 0209846 | 7/1992 |
| ES | 2011939 | 2/1990 |
| FR | 2529765 | 1/1984 |

(Continued)

*Primary Examiner* — David Walczak
*Assistant Examiner* — Bradley Oliver
(74) *Attorney, Agent, or Firm* — Thomas L. Adams

(57) ABSTRACT

A fluid dispenser includes an applicator attached to a base, as well as a case that is at least partially filled with a fluid. The base and case are telescopically mounted together and can be relatively reciprocated to retract and extend the applicator relative to the case. A piston is mounted in the case for outwardly urging the fluid.

24 Claims, 6 Drawing Sheets

FOREIGN PATENT DOCUMENTS

| | | |
|---|---|---|
| FR | 2562773 | 10/1985 |
| FR | 2563712 | 11/1985 |
| FR | 2580479 | 10/1986 |
| FR | 2585933 | 2/1987 |
| FR | 2598299 | 11/1987 |
| FR | 2607731 | 6/1988 |
| FR | 2701209 | 8/1994 |
| WO | 8906097 | 7/1989 |

* cited by examiner

DISPENSER AND METHOD FOR DISPENSING FLUIDS

CROSS-REFERENCES TO RELATED APPLICATIONS

This application claims the benefit of U.S. Provisional Patent Application Ser. No. 60/947,130, filed 29 Jun., 2007, the contents of which are hereby incorporated by reference herein.

BACKGROUND OF THE INVENTION

1. Field of the Invention

The present invention relates to fluid dispensing, and in particular, to devices and methods for storing and applying fluids.

2. Description of Related Art

Dispensers of fluids such as cosmetics are often sold in small bottles with an applicator brush extending from a cap.

Cosmetics such as mascara, lip gloss and blush are widely used and enjoyed by many. People use cosmetics to enhance natural beauty and physical appearance. Often, confidence and self-esteem are elevated by results achieved when cosmetics are properly applied.

However, there are many who choose to restrict or even forgo the application of cosmetics due to certain difficulties associated with application. For example, a conventional mascara container consists of a cylindrical bottle having an applicator brush extending downwardly from the bottle cap into the contained fluid. To apply the fluid, the cap is removed from the bottle, pulling the fluid-saturated brush along with it. Often the brush contains excess fluid, causing uncontrollable dripping during application. In many instances, dripping still occurs even when the brush is carefully scraped against the mouth of the bottle. In addition, excess mascara often forms a tail on the end of the brush which must be removed before application, to avoid pilling, clumping or smearing. Users may tap or wipe off the excess, but this approach often creates a messy situation. Also, a large amount of the product is then wasted.

Even if the user successfully removes the mascara tail and is fortunate to avoid dripping, often the brush is not evenly coated with mascara when it is extracted from the bottle. This uneven distribution can prevent a neat and accurate application of the fluid, requiring multiple passes over the eyelashes. As a result, some lashes receive too much fluid, while others do not receive any. This tends to cause the eyelashes to clump together, creating an unsightly appearance which is difficult to rectify.

Further, a substantial portion of the product is often wasted due to being dried inside the container. In some cases the mechanical design does not prevent air seepage so that the brush and cosmetic may dry inside the container. Before long, the fluid begins to dry out or cake on the brush and inside the bottle, preventing it from being used. It is not uncommon for as much as 30% of the fluid content to be wasted.

Although the above example applies to mascara, many of the same disadvantages are also found with lip gloss, eyeliner, lip-liner, blush, nail polish and other liquid cosmetics.

See U.S. Pat. Nos. 4,403,624; 4,687,364; 4,838,722; 4,750,502; 4,836,704; 4,976.562; 4,991,749; 5,042,955; 5,247,951; 5,349,972; 5,490,737; 5,851,079; 5,951,185; 6,231,256; 6,371,129; 6,718,990; 7,114,505; 7,237,973; and 4,838,722, as well as US Patent Application Publication Nos. 2004/0184865; 2005/0036823; 2006/0067781; and 2008/0056807. See also French Patent Publication Nos. 2563712; 2580479; 2598299; 2529765; 2562773; 2607731; 2585933; and 2701209. See also European Patent Specification Nos. 0 209 846; 0 163 323; 0 237 487; and 0 209 846. See also WO 8906097; ES 2011939 and DE 3808853.

SUMMARY OF THE INVENTION

In accordance with the illustrative embodiments demonstrating features and advantages of the present invention, there is provided a fluid dispenser. The dispenser has a base and an applicator attached to the base. Also included is a case at least partially filled with a fluid. The base and case are telescopically mounted together and are relatively reciprocatable to retract and extend the applicator relative to the case. The dispenser includes a piston mounted in the case for outwardly urging the fluid In accordance with another aspect of the invention a fluid dispensing method is provided. The method employs an applicator on a base that is telescopically mounted relative to a case that contains a fluid and a piston. The method includes in any order, the step of telescopically collapsing the base and case to expose the applicator. Another step is telescopically extending the base and case to sheath the applicator. The method includes the step of outwardly urging the piston to outwardly urge the fluid.

By employing apparatus and methods of the foregoing type an improved dispenser is achieved. In a disclosed embodiment, fluid is contained in a hollow case that is telescopically interfitted with a hollow base. An applicator such as a brush can be stored inside the case and mounted on a rod that is supported on the base, in the disclosed embodiment. The disclosed case can be closed with a cap; for example, an internally threaded collar fitted with a reciprocatable plunger. When the user depresses the plunger a slitted diaphragm on the plunger can wipe the tip of the applicator brush.

When the cap is removed and the base is telescopically collapsed into the case, the applicator brush can emerge through an opening at the end of the case. As the brush emerges from the case it passes by an annular lip that wipes excess fluid from the brush.

A fluid in the case, e.g., a cosmetic, can be urged through the case toward the applicator brush. The disclosed embodiment uses a piston that rides on a threaded sleeve, much like a lead screw. The threaded sleeve is rotatably mounted in the disclosed case at a fixed axial position relative to the case. The rod supporting the applicator brush can slide through the threaded sleeve and is keyed thereto. The user can turn the rod to turn the threaded sleeve and advance the piston inside the case. The outside end of the disclosed rod has an external ratchet wheel for turning the rod in one direction.

To prevent drying of the fluid when the dispenser is not in use, the disclosed embodiment has a number of sealing techniques. For example, to prevent leakage through the above-mentioned threaded sleeve, its inside end is tapered into a male fitting. The rod sliding through the threaded sleeve is fitted with a skirt that acts like a female fitting for engaging this male fitting much like a Luer fitting to prevent leakage through the threaded sleeve. This male and female fitting connect when the rod supporting the applicator brush is retracted into the case.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Referring to FIGS. 1-5, the illustrated fluid dispenser has a hollow base 12 telescopically fitted inside hollow case 10. For most of its length case 10 has the shape of a generalized right oval cylinder; that is, a tubular form with an oval cross-section. Case 10 tapers through front section 10A into a right cylindrical portion before stepping down into a smaller right cylindrical neck 10B. Projecting from neck 10B is a smaller cylindrical collar 10C with about 1½ turns of threads 14.

Figure 3:
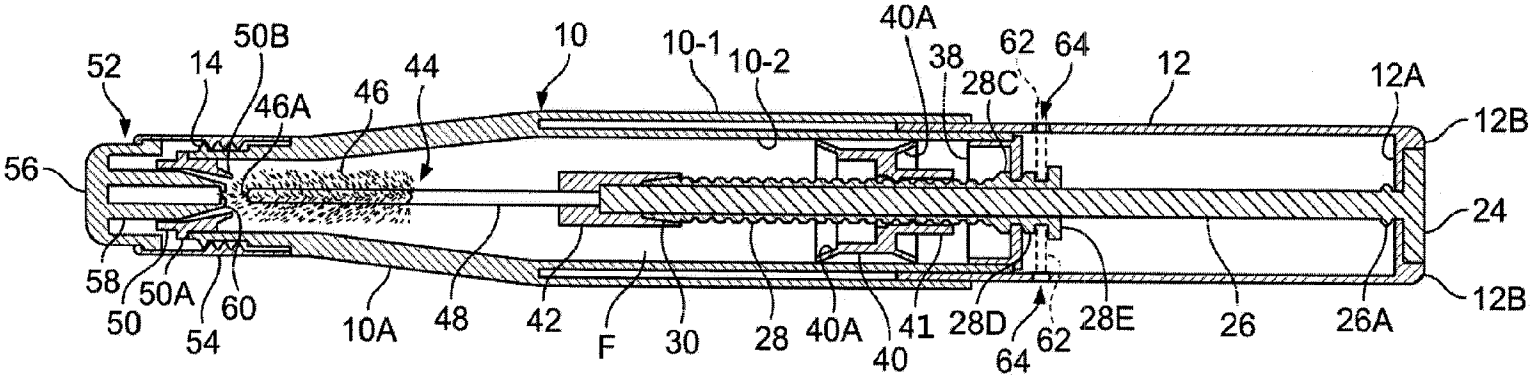
FIG. 3 is a side view, partly in section, of the dispenser of FIG. 1.
Figure 4:
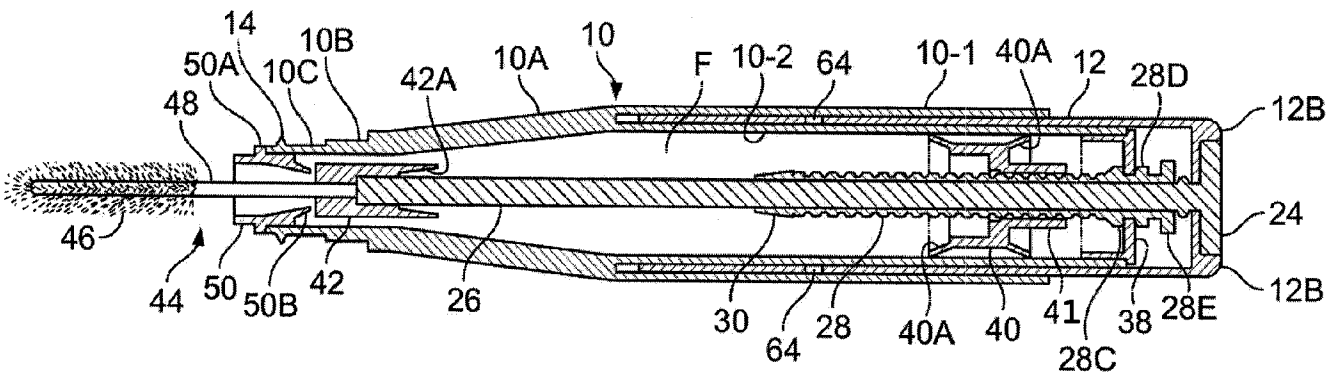
FIG. 4 is a side view, partly in section, of the dispenser of FIG. 2.
Figure 5:
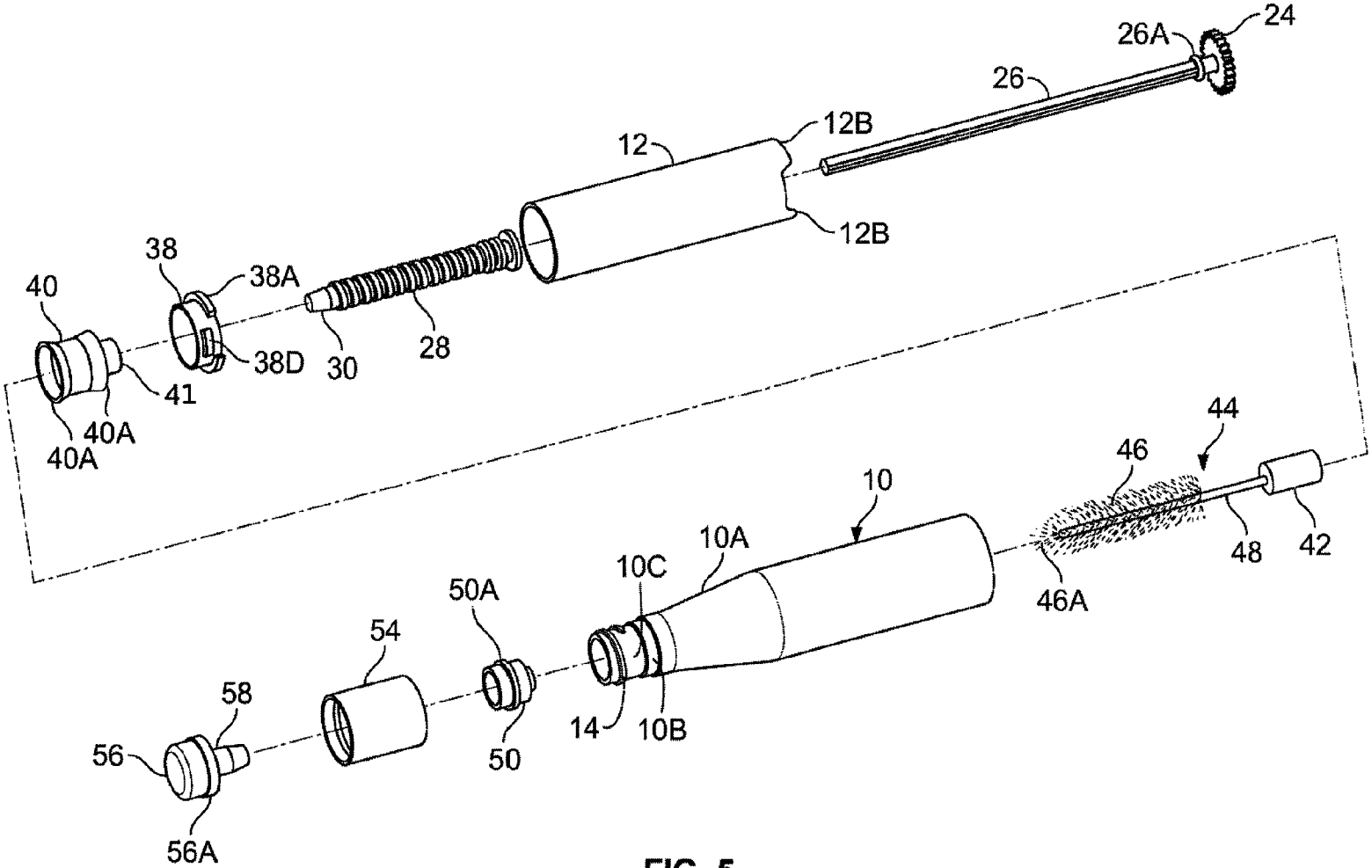
FIG. 5 is an exploded view of the dispenser of FIG. 1.

As shown in FIGS. 3 and 4, sections 10A, 10B and 10C have progressively thinner walls. The main portion of case 10 has a proximal double wall shown composed of outer wall 10-1 and inner wall 10-2. Inner wall 10-2 is shown extending beyond outer wall 10-1. Base 12 has the shape of a generalized right oval cylinder whose distal annular wall is sized to telescopically fit in the space between double walls 10-1 and 10-2. Having oval cross-sections, base 12 and case 10 cannot relatively rotate when fitted together. It will be appreciated that in other embodiments the respective cross-sections can have a polygonal, circular or other shape.

Figure 6:
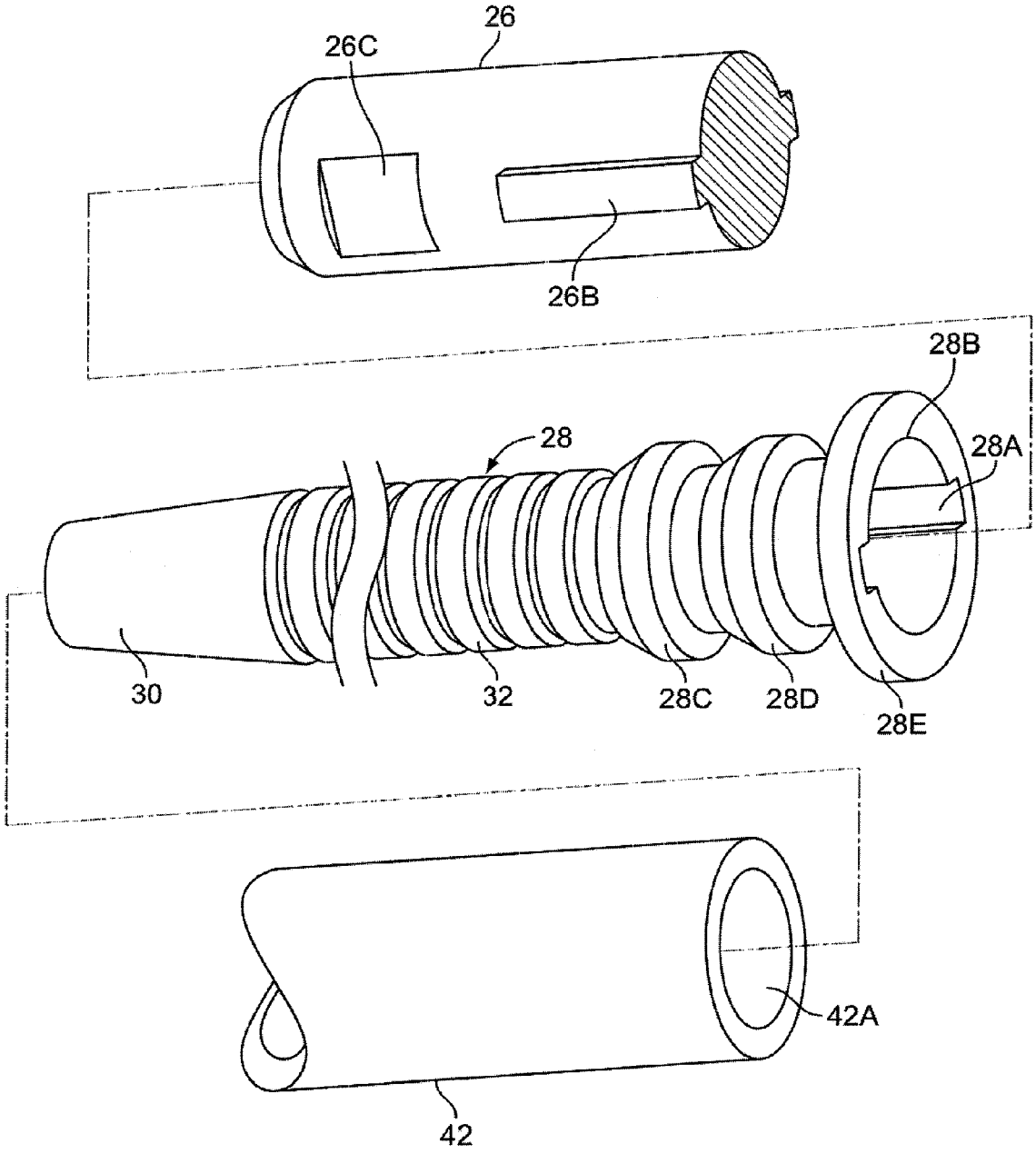
FIG. 6 is an exploded, detailed, fragmentary view of three of the components of FIG. 5.
Figure 8:
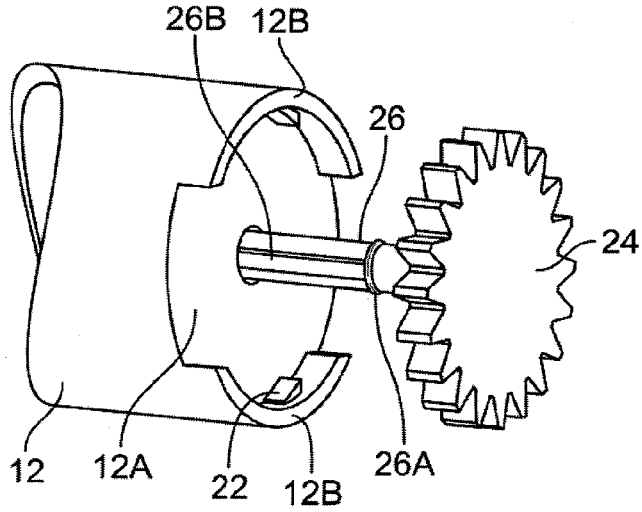
FIG. 8 is a detailed, fragmentary view of the end of the base of the dispenser of FIG. 1 with the dispensing wheel pulled away for illustrative purposes.

Referring to FIGS. 6 and 8, base 12 terminates in end wall 12A, which is bordered by a pair of arcuate overhangs 12B, each having an inwardly directed ratchet tooth 22 designed to engage ratchet thumbwheel 24 (also referred to as an exposed wheel). Perpendicularly projecting from the inside face of thumbwheel 24 is rod 26, a cylindrical shaft with annular ridge 26A for snapping the shaft into the hole in the center of end wall 12A.

Rod 26 is flanked with an opposing pair of longitudinal, rectangular bosses 26B designed to fit in rectangular slots 28A of otherwise cylindrical passage 28B of threaded sleeve 28. The distal end of sleeve 28 is shown as frustroconical male fitting 30, also referred to as a distal taper. External threads 32 are shown between fitting 30 and flange 28C, whose distal face is formed into a frustroconical taper. Flange 28D is spaced proximally from and shaped similarly to flange 28C. Flange 28E at the proximal end of sleeve 28 has a larger diameter than flanges 28C and 28D.

Figure 7:
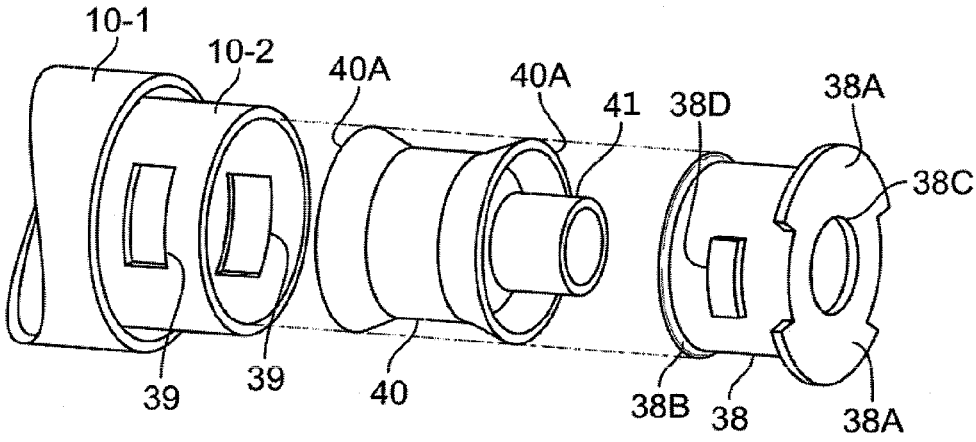
FIG. 7 is an exploded, detailed, fragmentary view of three other components of FIG. 5.

Referring to FIGS. 3, 4 and 7, the proximal end of inner wall 10-2 is fitted with a retainer 38, which again has the shape of a generalized right oval cylinder with a pair of partial flanges 34A on one end, and on the other end, an annular sealing ridge 38B. Threaded sleeve 28 snaps into opening 38C of retainer 38 with flange 28C on the inside and flange 28D on the outside of the retainer. Wedges 38D on opposite sides of retainer 38 are triangular prisms designed to snap into the two mating rectangular openings 39 near the end of inner wall 10-2.

Piston 40 has a midsection in the shape of a generalized right oval cylinder, providing an axially asymmetric periphery and having on either end flared annular projections 40A that act as seals against the internal surface of inside wall 10-2 of case 10. Having an oval cross-section, piston 40 will not rotate inside wall 10-2. In embodiments employing a circular cross-section, piston 40 may have may be keyed or have other means for preventing its rotation inside case 10. Projecting from one end of piston 40 is internally threaded central tube 41 designed to thread onto threaded sleeve 28.

Referring to FIGS. 3, 4 and 6, coupling 42 has a frustroconical mouth 42A acting as an intermediate taper or female fitting for sealingly engaging tapered fitting 30 of sleeve 28, much like a Luer fitting. Mouth 42A leads to a smaller cylindrical receptacle for holding the distal end of rod 26, which rod has a pair of recesses 26C designed to snap over nubs (not shown) on the inside of coupling 42. (Coupling 42 is also referred to as an intermediate section of support rod 26.)

Referring to FIGS. 2-5, distal applicator brush 44 has a bristle brush head 46 mounted on a wire stem 48, which stem is forced fit into a cylindrical bore on the distal end of coupling 42. Instead of force fitting, some embodiments may employ glue, heat sealing, etc. In this embodiment the bristles of brush head 46 may extend mostly radially from the axis of the brush head, but in other embodiments (e.g., nail polish embodiments) brush bristles may extend axially or otherwise. Applicator brush 44, coupling 42 and rod 26 are herein referred to as an applicator.

Referring to FIGS. 3-5, 10 and 11, collar 50 is pressed into the mouth of threaded neck 10C until flange 50A reaches the abutting position as shown. The inside of collar 50 converges somewhat and terminates in an annular lip 50B.

Figure 10:
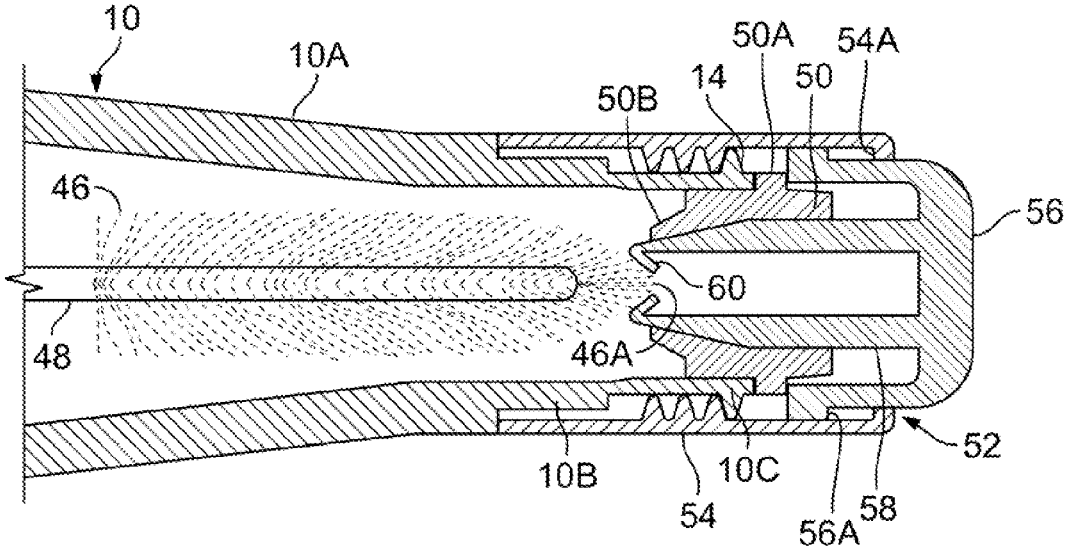
FIG. 10 is a side view, partly in section, of one end of the dispenser of FIG. 2 showing the depression of the plunger of the cap.
Figure 11:
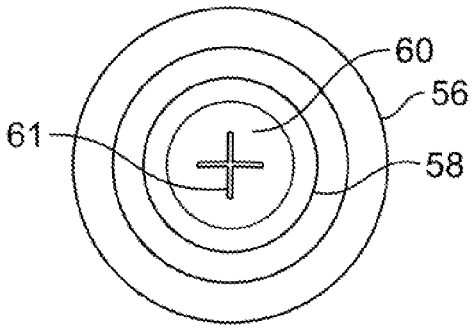
FIG. 11 is an inside end view of the plunger of FIG. 10.

Cap 52 screws onto section 10C, covering section 10B. Cap 52 has a collar 54 with internal threads engaging threads 14 on section 10C. An inwardly directed lip 54A on collar 54 captures flange 56A on plunger 56 of cap 52. Hollow tapered column 58 projects from the inside of plunger 56 and terminates in transverse, flexible diaphragm 60, shown pierced with cruciform slot 61. When plunger 56 is depressed inwardly as shown in FIG. 10 diaphragm 60 engages tip 46A of brush head 46 and flexes inwardly. In some embodiments column 58 or diaphragm 60 may be molded from a material that is more flexible than the rest of plunger 56.

Figure 1:
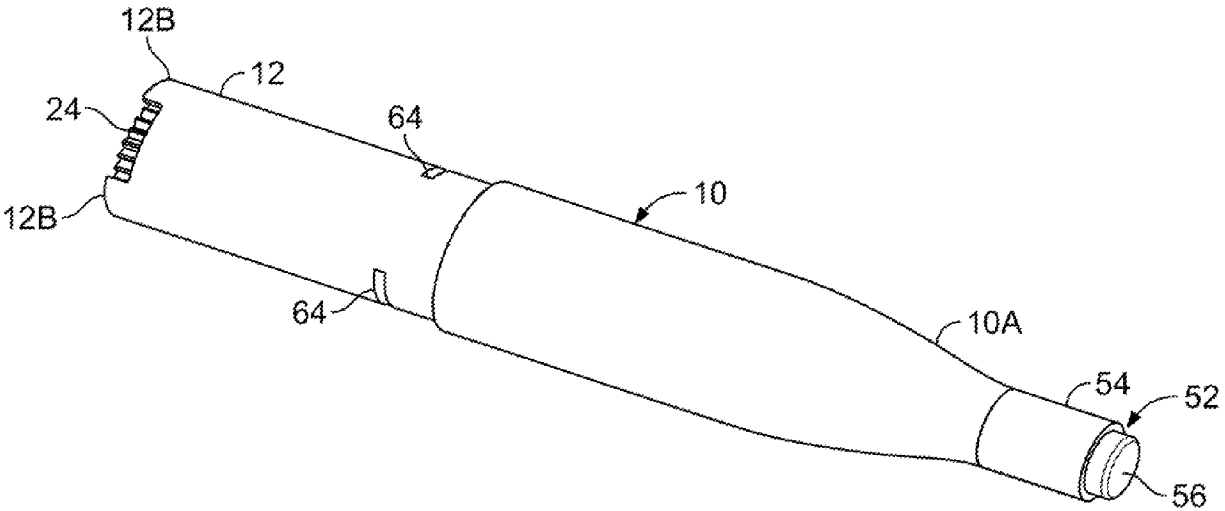
FIG. 1 is a perspective view of a fluid dispenser in accordance with principles of the present invention.
Figure 2:
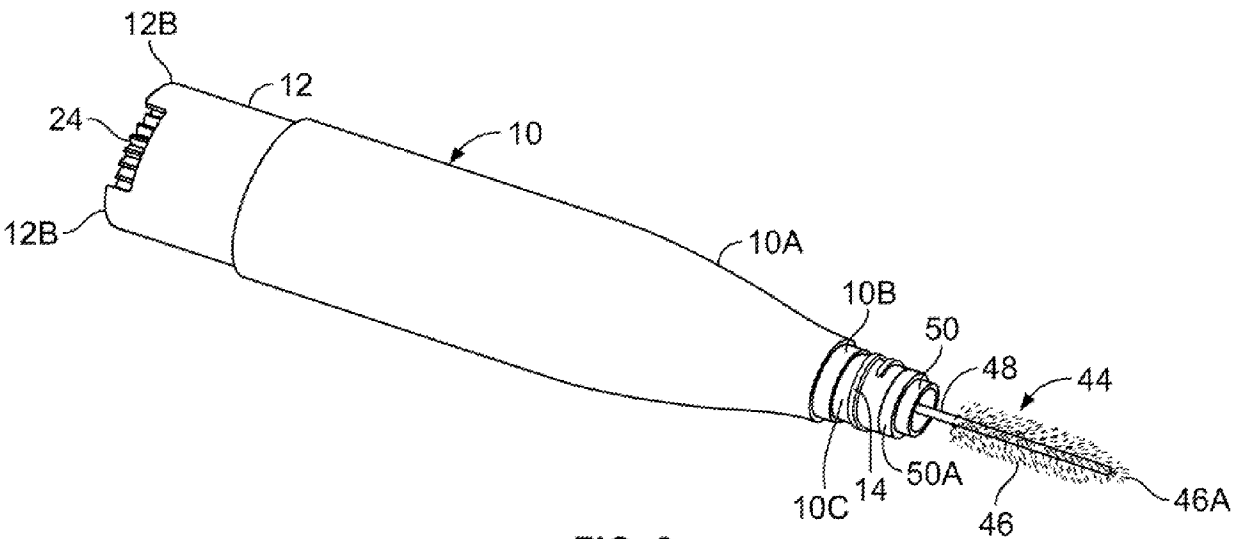
FIG. 2 is perspective view of the dispenser of FIG. 1 with its cap removed and its base and case telescopically collapsed to expose an applicator brush.
Figure 9:
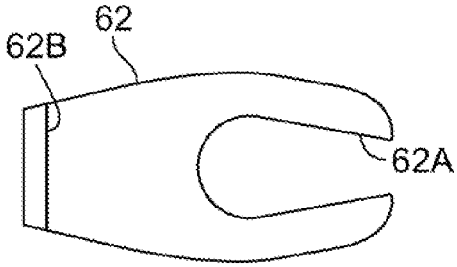
FIG. 9 is a side view of a locking clip that may be used with the dispenser of FIG. 1.

Referring to FIGS. 1, 3 and 9, U-shaped locking clip 62 is a plastic plate having a pair of legs 62A on one end, and on the other end, a gripping bead 62B. Clip 62 can be inserted into either one of slots 64 on opposite sides of base 12 when the case 10 is extended as shown in FIGS. 1 and 3 to expose these slots. As shown in phantom in FIG. 3 legs 62A of clip 62 straddle sleeve 28 between flanges 28D and 28E. Consequently, base 12 is locked to sleeve 28. Since sleeve 28 is locked to retainer 38, which is in turn locked to case 10, case 10 is locked to base 12. Accordingly, the dispenser will be locked in the extended position shown in FIG. 1.

To facilitate an understanding of the principles associated with the foregoing apparatus, its operation will be briefly described. The dispenser can be assembled as shown in FIGS.

1 and 3. The interior of case 10 can be filled with a fluid F such as a cosmetic. Since case 10 is filled with fluid F, brush 46 is likewise covered with this fluid. The cosmetic may be mascara, eyeliner, lip gloss, lipstick, eye shadow, rouge, nail polish, or the like.

The disclosed dispenser has several features for preventing drying of the fluid F due to the escape of moisture or due to the infiltration of ambient air. For example, ambient air infiltrating between rod 26 and sleeve 28 might reach coupling 42. However any air inside coupling 42 cannot proceed further since male fitting 30 fits tightly in the female fitting of coupling 42 (see frustroconical surface 42A of FIG. 4). Likewise, moisture from fluid F cannot escape along this path for the same reason.

Also, retainer 38 has tight sealing ridge 38B and also fits tightly around sleeve 28 to prevent drying of fluid F. In addition, cap 52 can be screwed tightly to avoid drying.

Before shipment, clip 62 can be inserted into slot 64 to lock case 10 and base 12 in the illustrated extended position. To use the dispenser, clip 62 must be removed from around sleeve 28 by gripping and pulling bead 62B (FIG. 9) of clip 62. Now sleeve 28, retainer 38 and case 10 can move together relative to base 12.

Being initially immersed in fluid F, brush 46 will carry an excessive amount of fluid F and must be wiped. Tip 46A of brush 46 can be wiped by depressing plunger 56 which will then move through collar 54 to the position shown in FIG. 10. Since diaphragm 60 has a cruciform slit (slit 61 of FIG. 11) brush tip 46A can pass between the petals of the diaphragm, thereby wiping excess fluid F from the brush tip. Once no longer pressed, plunger 56 will be urged outwardly by the force applied by brush 46 to diaphragm 60.

A user can turn collar 54 to unscrew cap 52 and expose case sections 10B and 10C, as well as collar 50. The user may now collapse base 12 and case 10 by sliding the wall of base 12 into the space between walls 10-1 and 10-2. In doing so, support rod 26, coupling 42 and brush applicator 44 move through case 10. In particular, brush 46 passes through lip 50B to wipe excess cosmetic fluid F off the brush. Eventually, brush 46 emerges from collar 50 and will be exposed as shown in FIG. 4. During this movement coupling 42 will disengage male fitting 30, but leakage is of little concern since case 10 is already open due to the removal of cap 52.

The user may now hold case 10 pencil-like and use brush 46 to apply cosmetic fluid F. Since brush 46 has been wiped including at its tip 46A, excess cosmetic fluid has been removed. Thus brush 46 will have a relatively uniform distribution of cosmetic fluid F without any tails. Thus the user will be able to apply cosmetic fluid F evenly. In the case of mascara, this uniform distribution avoids the need for excessive multiple passes over the eyelashes and thus avoids the tendency to overapply mascara and cause the eyelashes to clump together.

If during the foregoing process, the user notices that brush 46 is dry, the brush can be retracted into case 10. Specifically, the user may telescopically expand the dispenser by pulling the wall of base 12 from the space between walls 10-1 and 10-2. This will again immerse brush 46 in cosmetic fluid F before the brush is again deployed and wiped in the manner just described.

As this routine is repeated (in the current or future sessions), eventually insufficient fluid F will remain around brush 46. This is especially the case with a viscous cosmetic fluid such as mascara. When the user notices that brush 46 is dry, the brush can be retracted into case 10 as previously described.

With cap 52 still removed, the user can then turn wheel 24 to turn rod 26. Since spline 26B (FIG. 6) keys rod 26 in slot 28A of sleeve 28, sleeve 28 will turn as well. Threaded sleeve 28 turns and acts as a lead screw, moving piston 40 closer to brush 46. Thus cosmetic fluid F will be urged towards brush 46, replenishing it. Because of the ratcheting action of teeth 22 (FIG. 8) wheel 24 can be turned in only one direction; namely, the direction that advances piston 40 towards brush 46. Brush 46 can then be redeployed and the user can continue applying fluid F.

Once cosmetic fluid F has been fully and satisfactorily applied, the user may retract brush 46 in the manner just described. Accordingly, brush 46 will pass through collar 50 and reach the position shown in FIG. 3. The female fitting 42A of coupling 42 will reengage male fitting 30, restoring the previously described seal that prevents drying. Cap 52 may now be screwed in place, as shown in FIG. 3.

It is appreciated that various modifications may be implemented with respect to the above described embodiments. The foregoing showed some elements as multiple interconnected components but in other embodiments one or more of these elements may be fabricated as a single integral unit. Alternatively, some elements shown as a single integral unit may be fabricated from multiple components. While the foregoing dispenser can be made by injection molding of plastic, other embodiments may employ metals or other materials that are formed in a variety of ways. Also, the shapes, proportions, and dimensions disclosed herein may be varied depending upon the desired size, capacity, strength, aesthetic considerations, etc.

Obviously, many modifications and variations of the present invention are possible in light of the above teachings. It is therefore to be understood that within the scope of the appended claims, the invention may be practiced otherwise than as specifically described.

The invention claimed is:

1. A fluid dispenser comprising:
a base;
an applicator attached to said base and having a support rod;
a threaded sleeve mounted around said support rod;
a case at least partially filled with a fluid, said base and case being telescopically mounted together and being relatively reciprocatable to retract and extend said applicator relative to said case; and
a piston mounted in said case for outwardly urging said fluid, said piston being threaded on said threaded sleeve.

2. A fluid dispenser according to claim 1 wherein said rod is keyed to said threaded sleeve to prevent relative rotation but allow relative axial translation.

3. A fluid dispenser according to claim 2 wherein said rod terminates in an exposed wheel for manually turning said rod and said threaded sleeve relative to said case and said base.

4. A fluid dispenser according to claim 3 wherein said exposed wheel ratchets on said base to allow said threaded sleeve to unidirectionally drive said piston outwardly.

5. A fluid dispenser according to claim 1 wherein said fluid is a cosmetic.

6. A fluid dispenser according to claim 1 wherein said applicator has a distal brush, said case having an annular lip located distally for wiping said brush upon its passage by said lip.

7. A fluid dispenser according to claim 1 wherein said case has an internal surface shaped to mate with said piston, said piston having an axially asymmetric periphery to prevent rotation relative to said case.

8. A fluid dispenser according to claim 7 wherein said piston has a flared annular projection for sealingly engaging the internal surface of said case.

9. A fluid dispenser according to claim 7 wherein said case, said base, and said piston have mating oval cross-sections.

10. A fluid dispenser comprising:

a base;

an applicator attached to said base and having a support rod;

a threaded sleeve mounted around said support rod, said sleeve having a distal end with a distal taper, said rod having an intermediate section with an intermediate taper, said rod being slidable within said threaded sleeve from a position where said intermediate and said distal taper are sealingly engaged to another position where said intermediate and said distal taper are disengaged;

a case at least partially filled with a fluid, said base and case being telescopically mounted together and being relatively reciprocatable to retract and extend said applicator relative to said case; and a piston mounted in said case for outwardly urging said fluid.

11. A fluid dispenser according to claim 10 wherein said intermediate taper includes an annular concavity acting as a female fitting, said distal taper acting as a male fitting.

12. A fluid dispenser comprising:

a base having a distal annular wall;

an applicator attached to said base;

a case at least partially filled with a fluid, said base and case being telescopically mounted together and being relatively reciprocatable to retract and extend said applicator relative to said case, said case having a proximal double wall providing a space for receiving the distal annular wall of said base; and a piston mounted in said case for outwardly urging said fluid.

13. A fluid dispenser comprising:

a base;

an applicator attached to said base, said applicator having a distal brush;

a case at least partially filled with a fluid, said base and case being telescopically mounted together and being relatively reciprocatable to retract and extend said applicator relative to said case, said case having an annular lip located distally for wiping said brush upon its passage by said lip;

a cap removably mounted on said case, said cap having a collar and a plunger reciprocatably mounted on said collar, said plunger having a flexible diaphragm that is pierced to allow passage of at least part of said brush upon inward thrusting of said plunger; and a piston mounted in said case for outwardly urging said fluid.

14. A fluid dispenser according to claim 13 wherein said diaphragm has a cruciform slot.

15. A fluid dispenser comprising:

a base;

an applicator attached to said base and having a support rod;

a case at least partially filled with a fluid, said base and case being telescopically mounted together and being relatively reciprocatable to retract and extend said applicator relative to said case;

a piston mounted in said case for outwardly urging said fluid;

a threaded sleeve mounted around said support rod; and a retainer having an annular ridge for sealing said retainer to said case, said threaded sleeve being rotatably mounted in said retainer.

16. A fluid dispenser comprising:

a base;

an applicator attached to said base and having a support rod;

a threaded sleeve mounted around said support rod;

a case at least partially filled with a fluid, said base and case being telescopically mounted together and being relatively reciprocatable to retract and extend said applicator relative to said case; and a piston mounted in said case for outwardly urging said fluid; and a retainer mounted at said case for rotatably holding said threaded sleeve without permitting axial translation.

17. A fluid dispenser according to claim 16 comprising:

a locking clip mounted at said base for preventing axial translation of said threaded sleeve relative to said base.

18. A fluid dispenser according to claim 16 wherein said base has a locking slot, said dispenser comprising:

a U-shaped locking clip mounted though said locking slot to straddle a portion of said threaded sleeve.

19. A fluid dispenser comprising:

a base;

an applicator attached to said base and having a support rod;

a threaded sleeve mounted around said support rod;

a case at least partially filled with a fluid, said base and case being telescopically mounted together and being relatively reciprocatable to retract and extend said applicator relative to said case; and a piston mounted in said case for outwardly urging said fluid, said piston having on each of opposite ends a flared annular projection for sealingly engaging the internal surface of said case, said piston having a central tube threaded on said threaded sleeve.

20. A fluid dispensing method employing an applicator with a brush on a base that is telescopically mounted relative to a case that contains a fluid and a piston, the case having a cap with a plunger, the method including the steps, in any order, of:

reciprocating the plunger in the cap to wipe just the tip of said brush with a reciprocating motion;

removing the cap from the case;

telescopically collapsing the base and case to expose the applicator and wipe the brush over most of its length;

telescopically extending the base and case to sheath the applicator; and outwardly urging the piston to outwardly urge the fluid.

21. A fluid dispensing method according to claim 20 employing a threaded sleeve screwed into the piston and including the step of:

turning the threaded sleeve to move the piston.

22. A fluid dispensing method 20 employing a threaded sleeve screwed into the piston and wherein the step of telescopically collapsing the base and case includes the step of:

sealing the threaded sleeve from external air.

23. A fluid dispensing method 20 wherein the applicator includes a brush, the step of telescopically extending the base and case including the step of:

wiping the brush over most of its length.

24. A fluid dispensing method 23 including the step of:

applying the fluid to a human face with the applicator.

* * * * *